US005114751A

United States Patent [19]

Ahmed et al.

[11] Patent Number: 5,114,751

[45] Date of Patent: May 19, 1992

[54] APPLICATION OF AN ORGANIC COATING TO SMALL METAL ARTICLES

[75] Inventors: Bashir M. Ahmed, Ambler; Barry P. Gunagan, Hatboro, both of Pa.; Wilbur S. Hall, Springvale, Me.

[73] Assignee: Henkel Corporation, Ambler, Pa.

[21] Appl. No.: 759,096

[22] Filed: Sep. 6, 1991

Related U.S. Application Data

[63] Continuation of Ser. No. 426,146, Oct. 24, 1989, abandoned.

[51] Int. Cl.[5] ..... B05D 1/02

[52] U.S. Cl. ..... 427/242; 427/304; 427/436; 427/437; 427/443.1; 118/417; 118/423

[58] Field of Search ..... 118/417, 423, 425; 427/242, 216, 304, 436, 437, 443.1

[56] References Cited

U.S. PATENT DOCUMENTS

| | | | |
|---|---|---|---|
| 3,021,231 | 2/1962 | Samuel et al. | 427/216 |
| 3,647,567 | 3/1972 | Schweri | 148/6.15 R |
| 3,709,743 | 1/1973 | Dalton et al. | 148/6.2 |
| 3,795,546 | 3/1974 | Hall | 148/6.2 |
| 3,853,094 | 12/1974 | Christini et al. | 118/417 |
| 3,864,149 | 2/1975 | Scheiber | 117/64 |
| 3,955,532 | 5/1976 | Hall et al. | 118/612 |
| 4,030,945 | 6/1977 | Hall et al. | 427/435 X |
| 4,103,049 | 7/1978 | Nishida et al. | 427/341 |
| 4,109,612 | 8/1978 | Mayer | 118/417 |
| 4,178,400 | 12/1979 | Lochel, Jr. | 427/435 |
| 4,180,603 | 12/1979 | Howell, Jr. | 427/353 |
| 4,191,676 | 3/1980 | Hall | 260/297 R |
| 4,199,624 | 4/1980 | Smith | 427/309 |
| 4,242,379 | 12/1980 | Hall et al. | 427/327 |
| 4,313,861 | 2/1982 | Bassett et al. | 260/29.6 H |
| 4,318,944 | 3/1982 | Hall | 427/377 |
| 4,347,172 | 8/1982 | Nishida et al. | 524/319 |
| 4,554,305 | 11/1985 | Hall | 524/321 |
| 4,562,098 | 12/1985 | Ahmed | 427/341 |
| 4,637,839 | 1/1987 | Hall | 148/6.2 |
| 4,647,480 | 3/1987 | Ahmed | 427/341 |
| 4,657,788 | 4/1987 | Benton et al. | 427/354 |
| 4,710,410 | 12/1987 | Narusch, Jr. | 118/423 X |

FOREIGN PATENT DOCUMENTS

| | | |
|---|---|---|
| 0310709 | 7/1984 | European Pat. Off. . |
| 0186113 | 12/1985 | European Pat. Off. . |

OTHER PUBLICATIONS

English equivalent abstracts for European Patents 186113 and 0071355.

*Primary Examiner*—Shrive Beck
*Assistant Examiner*—Alain Bashore
*Attorney, Agent, or Firm*—Ernest G. Szoke; Wayne C. Jaeschke; Norvell E. Wisdom, Jr.

[57] ABSTRACT

A process forming an organic coating, such as an autodeposited coating, on a plurality of small metallic articles by contacting the articles with a liquid coating composition containing an organic film-forming material comprising:

(A) providing a plurality of said articles, with at least some of the articles being in contact with at least one other of said articles;

(B) immersing the articles into a bath of said composition under conditions such that said articles are not in conttact with another article in said composition;

(C) maintaining said articles in separated form in said composition for a period of time sufficiently long for the entirety of the surfaces of said articles to be coated with said composition; and (D) collecting the coated articles in the bath in a form in which at least some of the coated articles are in contact with another of said coated articles;

wherein the coating composition is capable of forming on a steel panel immersed therein a coating having a wet strength such that its rinse resistance is at least about 30 seconds.

20 Claims, 2 Drawing Sheets

APPLICATION OF AN ORGANIC COATING TO SMALL METAL ARTICLES

CROSS-REFERENCE TO RELATED APPLICATION

This application is a continuation of copending U.S. application Ser. No. 426,146 filed Oct. 24, 1989 now abandoned.

FIELD OF THE INVENTION

This invention relates to coating a plurality of small metallic articles. More specifically, this invention relates to applying an organic coating to a plurality of small metallic articles by immersing the articles into a liquid coating composition which includes an organic film-forming material.

This invention will be described initially in connection with the use of an autodepositing composition to coat a plurality of small metallic articles. However, as will be explained hereinbelow, its use has wider applicability.

Autodepositing compositions are particularly suited to the coating of metallic surfaces to form thereon coatings which function typically to protect the underlying metallic surface from corrosive elements. For many applications, it is essential that the autodeposited coating have not only excellent corrosion-resistant properties, but also other properties, for example, good physical and aesthetic properties.

Autodepositing compositions generally comprise, as essential constituents, organic film-forming solids dispersed in water and an activator. The activator comprises one or more ingredients which function to dissolve from the metallic surface being coated metal ions in an amount sufficient to directly or indirectly cause the film-forming solids in the region of the metallic surface to deposit thereon in a continuous fashion. Thus, an autodepositing composition is characterized by its ability to form on a metallic surface immersed therein a coating which increases in thickness or weight the longer the time the metallic surface is immersed in the composition. This type of coating process, often referred to as "autodeposition", is similar to electrodeposition, but does not require the use of an external electrical current for operability, as is required in electrodeposition.

A popularly used autodepositing composition comprises an aqueous acidic solution of hydrofluoric acid and ferric fluoride (the activating ingredients) and resin solids dispersed therein. A latex is used conveniently as the source of the resin solids.

Commercial applications involving the use of autodepositing compositions include the coating of metallic articles of relatively large size, for example, mounting rings for headlights, vehicle frame members, parts for home appliances and under-the-hood vehicle parts.

In a typical industrial operation, the articles to be coated are hung from a mount on a conveyor line which carries the articles through various pre-treating stages (for example, a cleaning stage), to a bath of autodepositing composition into which the articles are immersed, and then to post treating stages (for example, rinsing and then through an oven in which the coating is coalesced to form a continuous film). The conveyor line is designed in a manner such that, as the articles reach the bath, the line dips toward the bath sufficiently low to permit the mounted article to be immersed in the composition as it is pulled through the composition. In some applications, several articles are hung from the same mount in a manner such that they are immersed in the composition concurrently.

Although the aforementioned system is practical for coating relatively large-sized articles which can be hung individually and conveniently on the mounts of the conveyor line, the system is not practical for coating articles of relatively small size, for example, fasteners, hinges, nuts, and turnbuckles. It would be grossly inefficient to hang such articles individually on such mounts.

Accordingly, this invention relates to coating in an efficient manner a multiplicity of small-sized metallic articles with a liquid coating composition which contains an organic film-forming material.

REPORTED DEVELOPMENTS

The art relating to autodeposition does not address specifically the problem of coating a multiplicity of small-sized articles. However, various patents relating to autodeposition disclose various techniques for improving the quality of coatings formed from autodepositing compositions and for improving the efficiencies of the coating process.

For example, U.S. Pat. No. 3,585,084, to the applicant Hall herein and Steinbrecher, discloses that the rate of coating formation can be increased by maintaining relative motion between the autodepositing composition and the metallic article immersed therein. This can be accomplished by either stirring the composition or by moving the article in the composition. U.S. Pat. No. 3,955,532, also to the applicant Hall herein and Leister and Robinson, discloses an agitating system for imparting to an autodepositing composition a random or omnidirectional flow relative to the article being coated. This is said to aid in forming coatings which are uniform in thickness over the entirety of the article being coated.

U.S. Pat. No. 4,657,788 discloses that the corrosion resistance of autodeposited coatings can be improved by utilizing a multi-stage coating process. In the process, metal articles are coated in a bath of the autodepositing composition, withdrawn therefrom, rinsed with water, optionally dried, and then subjected again to the coating composition. This sequence of steps is repeated several times after which the coated article is heated to cure or fuse the coating.

The aforementioned patents refer to immersing the articles into the composition individually.

It is known to coat small objects such as hairpins with a conventional paint by "tumbling" thereof. This involves placing the objects in a drum, together with an amount of paint sufficient to cover the total surface of all the objects, and rotating the drum until the objects are coated with the paint. The coated objects are removed from the drum, placed onto wire trays, and then air-dried or baked. The use of this method to form autodeposited coatings on a batch of small ferriferous articles produced coatings of unsatisfactory quality. Close examination of the coated articles showed that small areas of the article remain uncoated. Such defects lead to early degradation of the metallic surface, for example, rusting of the ferriferous surface.

Although the aforementioned tumbling method of coating is unsatisfactory for use with an autodepositing composition, the batch coating of small-sized articles, as used in this method, is more efficient than coating the articles individually. Accordingly, an aspect of the present invention is the provision of an effective way to apply an organic coating to a batch of small-sized metallic articles.

SUMMARY OF THE INVENTION

In accordance with the present invention, there is provided a process for forming an organic coating on a plurality of small metallic articles by contacting the articles with a liquid coating composition containing an organic film-forming material comprising:

(A) providing a plurality of said articles, with at least some of the articles being in contact with at least one other of said articles;

(B) immersing the articles into a bath of said composition under conditions such that said articles are not in contact with another article in said composition;

(C) maintaining said articles in separated form in said composition for a period of time sufficiently long for the entirety of the surfaces of said articles to be coated with said composition, thereby forming on said articles an organic coating which is capable of coalescing into a continuous film;

(D) collecting the coated articles in the bath in a form in which at least some of the coated articles are in contact with another of said coated articles;

(E) withdrawing from said composition, said coated articles, including those in contact with other of said articles; and thereafter (F-1) rinsing said coated articles with water and forming said continuous film from said coating; or (F-2) forming said continuous film on said coated articles under conditions such that the coated articles are not in contact with another article;

wherein the coating composition is capable of forming on a steel panel immersed therein a coating having a wet strength such that its rinse resistance is at least about 30 seconds. The rinse resistance, which is a measure of the wet strength of the coating, is determined by a test described hereinbelow. Briefly stated, the test involves subjecting the freshly formed coating to running water under controlled conditions and observing whether the running water ruptures the coating within a specified time.

In preferred form, the rinsing step of (F-1) above is effected under conditions such that the coated articles are not in contact with other of said articles.

Preferred means for accomplishing the foregoing are as follows. One preferred embodiment of the present invention involves placing a batch of the small-sized articles in a container having openings in its bottom and side walls and immersing the container into a bath of liquid coating composition with a force sufficient to cause the articles which are in contact with other articles to be separated one from the other for a sufficient period of time to enable the coating composition to contact the entirety of the surface of the article. Another preferred embodiment of the present invention involves dropping a plurality of small-sized articles through the air into a bath of the liquid coating composition which coats the entirety of the surface of each of the articles during their free-fall in the composition. An additional preferred embodiment of the present invention involves immersing into a bath of the coating composition a batch of the small-sized articles contained within the barrel of a tumbler having openings in its walls and rotating the barrel about is longitudinal axis. As articles are tumbled within the barrel, their surfaces are coated by the composition as they are moved out-of-contact with other of the articles by the tumbling movement imparted to the articles by the movement of the barrel.

This invention includes also within its scope a metal fastener which is coated with an autodeposited coating.

In preferred form, the present invention encompasses the use of an autodepositing composition having a predetermined activity which is dependent upon the nature of the article being coated. In this connection, a preferred process involves the use of a composition which is capable of forming on the article a coating having a thickness of no greater than about 0.3 mil within about 1 second.

Utilizing the process of the present invention, it is possible to form defect-free organic coatings on a large number of small-sized articles in a consistent and efficient manner. The present invention can be used in an indexing line (batch operation) or in a continuous system such as one involving the use of a conveyor line.

The application of conventional paints to threaded articles such as, for example, nuts, bolts, and screws, tends to form coatings which are non-uniform in thickness and/or so thick as to render the articles unusable. The coatings form in a manner such that they fill the valleys of the threaded parts and/or have poor adherence to the sharp edges thereof. Such problems can be avoided by the practice of the present invention which can be used to form on such articles coatings which are uniformly thick and tightly adherent.

DETAILED DESCRIPTION OF THE INVENTION

Figure 1A:
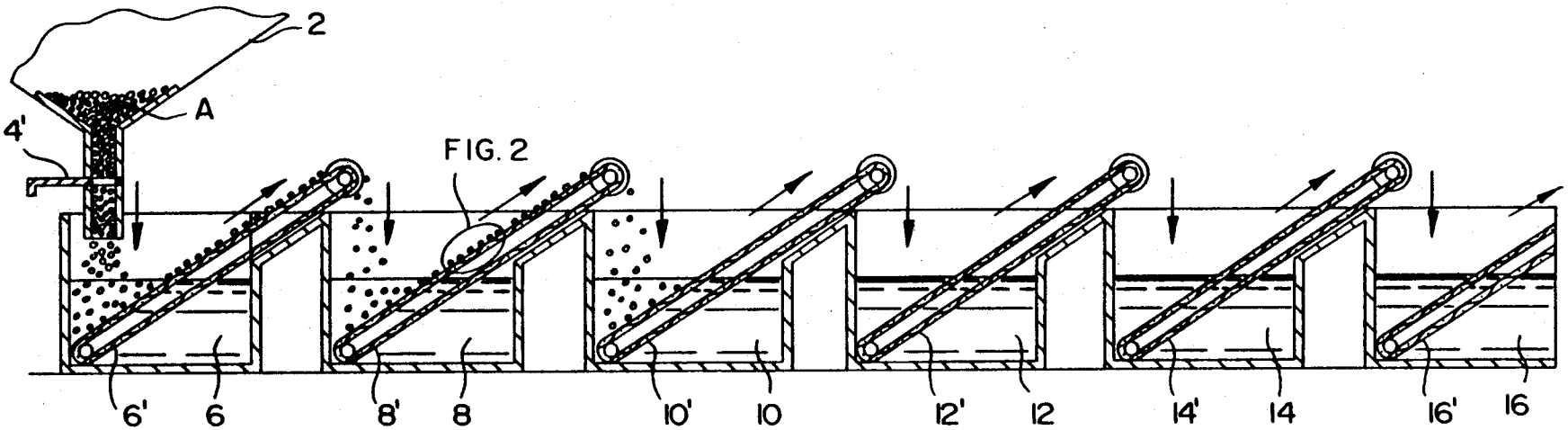
FIGS. 1A and 1B illustrate schematically equipment used in the coating of small articles according to the present invention.

It is believed that the present invention will be utilized most widely in coating processes which include the use of an autodepositing composition to form resinous coatings on a multiplicity of small-sized articles.

Such autodepositing compositions generally comprise, as essential constituents, resin solids dispersed in water and one or more soluble activating ingredients, for example, acid and oxidizing agent. Autodepositing compositions differ from conventional paint compositions in that the amount of coating deposited on a metallic surface immersed in an autodepositing composition is a function of the time of contact between the composition and the immersed surface. The longer the time the surface is in contact with the composition, the greater the amount of resin deposited on the surface. Such deposition of the resin on the metallic surface is achieved through the chemical action of the coating composition on the metallic surface and is attributed to the activating ingredients. Conventional paints, including both oil-based and water-based paints (latexes) do not contain such activating ingredients. And, the amount of coating deposited on a metallic surface immersed in such paints is not a function of the time the metallic surface is immersed in the paint.

Examples of activators for converting aqueous dispersions of resin solids into autodepositing compositions are disclosed in U.S. Pat. Nos: 3,592,699; 3,709,743;

4,103,049; 4,347,172; 4,373,050; and 4,554,305, the disclosures of which are incorporated herein by reference. The activating systems disclosed in the aforementioned patents include those in which the oxidizing agent comprises a non-metal containing compound (for example, hydrogen peroxide), a metal-containing compound (for example, ferric fluoride) and a compound which functions also as the acidic constituent (for example, nitric acid). Various acids, including inorganic and organic acids, can be used as a component of the activating system, as described in the aforementioned patents.

The preferred autodepositing composition for use in the practice of the present invention includes an activating system comprising a ferric-containing compound and hydrofluoric acid, for example, a soluble ferric-containing compound in an amount equivalent to about 0.025 to about 3.5 g/l of ferric iron, most preferably about 0.3 to about 1.6 g/l of ferric iron, and hydrofluoric acid in an amount sufficient to impart to the composition a pH of within the range of about 1.6 to about 5. Examples of the aforementioned ferric-containing compounds are ferric nitrate, ferric chloride, ferric phosphate, ferric oxide, and ferric fluoride, the last mentioned being preferred.

The resin solids which are dispersed in the aqueous phase of the autodepositing composition comprise the organic film-forming constituent of the composition. They are typically associated with or include as part of their structure groups which carry an ionic charge which is believed to be responsible for the unique manner in which autodeposited coatings are formed (see, for example, U.S. Pat. No. 4,191,676). The ionic charge-bearing group may be part of the structure of surfactant molecules which are adsorbed to the surface of the resin particles (externally stabilized resins) or they may be part of the chemical structure of the resin particles (internally stabilized resins). The group is typically a negatively charged group. The source of the resin solids is most conveniently a latex, that is, an aqueous dispersion of solid particles of the resin.

The following publications disclose examples of resins that can be used as the film-forming constituent of the autodepositing composition: U.S. Pat. Nos. 3,585,084; 3,709,743; 4,180,603; 4,191,676; 4,313,861 and 4,347,142; and European Patent Application bearing Publication No. 0 071 355. A few examples of classes of resins that can be used in autodepositing compositions are polyethylenes, polytetrafluoroethylenes; vinyl-based resins, for example, acrylic and alkyl-substituted acrylic resins, styrene-butadiene type resins and resins prepared from other ethylenically unsaturated monomeric compounds.

Particularly preferred classes of resins for use in the practice of the present invention comprise externally stabilized vinylidene chloride copolymers and internally stabilized vinylidene chloride copolymers containing a major amount of vinylidene chloride. Of these two classes of resins, the internally stabilized copolymers are preferred. Most preferably, each of the aforementioned resin classes is crystalline in nature. The crystalline form of the resin comprises a relatively high proportion of vinylidene chloride, for example, at least about 80 wt. % thereof. Autodeposited coatings prepared from vinylidene chloride-containing copolymers can have extremely high resistance to corrosion without being treated with an aqueous solution of chromium compounds or other post treatment steps designed to improve the corrosion resistance of autodeposited coatings. In addition, such coatings can be cured at relatively low temperatures, have exceptionally high hardness and superior resistance to solvents and have exceptionally good adhesive and cohesive properties substantially immediately upon being formed.

Autodepositing compositions including the aforementioned vinylidene chloride copolymers are described in U.S. Pat. No. 4,562,098, the disclosure of which is incorporated herein by reference as respects such copolymers. Briefly, one of the internally stabilized forms of the resin comprises the following polymerized constituents:

(1) about 55 to about 99 wt. % based on the total weight of monomers used of vinylidene chloride monomer;

(2) about 0.5 to about 30 wt. % based the total weight of (1) and (2) of a second relatively more hydrophilic ethylenically unsaturated monomeric material wherein such monomeric material has a solubility in both the water phase and the oil phase of the polymer latex of at least 1 weight percent at the temperature of polymerization; and (3) from about 0.1 to about 5 wt. % based on the total weight of other monomers of an ionic significantly water-soluble material which is copolymerizable with (2) and is selected from the group of sulfonic acids and their salts having the formula:

$$R—Z—Q—(SO_3)^{-}M^{+}$$

wherein "R" is selected from the group consisting of vinyl and substituted vinyl, for example, alkyl-substituted vinyl; "Z" represents a difunctional linking group which will activate the double bond in the vinyl or substituted vinyl group; "Q" is a divalent hydrocarbon having its valence bonds on different carbon atoms; and "M+" represents a cation.

Exemplary of preferred hydrophilic monomers of (2) above, particularly when used in conjunction with monomeric vinylidene chloride are: methacrylic acid and methyl methacrylate. Other monomers which may be advantageously employed include the hydroxyethyl and propyl acrylates, hydroxyethylmethacrylate, ethyl hexylacrylate, acrylic acid, acrylonitrile, methacrylonitrile, acrylamide, and the lower alkyl and dialkylacrylamides, acrolein, methylvinyl ketone, and vinyl acetate.

Examples of the difunctional linking group "Z" which will activate the double bond present in the vinyl or substituted vinyl group include groups of the structure:

$$-\overset{O}{\overset{\|}{C}}-,\quad -\overset{O}{\overset{\|}{C}}-O-,\quad -O-\overset{O}{\overset{\|}{C}}-,\quad -\overset{\text{O-alkyl or H}}{\overset{|}{C}}-N-$$

and the like. The alkyl group is preferably alkyl of 1 to about 8 carbon atoms, especially methyl, ethyl or propyl.

Examples of the "Q" divalent hydrocarbon having its valence bonds on different carbon atoms include alkylene and arylene divalent hydrocarbon radicals. Although the alkylene ($CH_2$) group can contain up to about 20 carbon atoms, it will generally have 1 to about 8 carbon atoms.

The solubility of the defined copolymerizable ionic material as described herein is strongly influenced by the cation $M^+$. Exemplary cations are the free acids, alkali metal salts, ammonium and amine salts and sulfonium and quaternary ammonium salts. Preferred are the free acids, alkali metal salts, particularly sodium and potassium, and ammonium salts.

Sodium sulfoalkyl methacrylate of the formula:

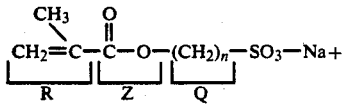

wherein n is 2, is a highly acceptable copolymerizable ionic material for use in preparing the aforementioned copolymers. Sodium sulfoethyl methacrylate is particularly effective for use with monomeric vinylidene chloride and the relatively hydrophilic monomers methyl methacrylate or methacrylic acid when used in the amounts and in the manner described above.

Another particularly preferred class of resins which are recommended for use in the practice of the present invention are those prepared by polymerizing: (A) about 1 to about 10 wt. % of acrylic acid or any alkyl-substituted acrylic acid, preferably methacrylic acid; (B) about 25 to about 50 wt. % of an acrylic ester or an alkyl-substituted acrylic ester, preferably ethyl hexylacrylate; (C) about 15 to about 40 wt. % of a nitrilo monomer, preferably acrylonitrile; and (D) about 10 to about 50 wt. % of an additional polymerizable aryl compound, preferably styrene. An example of a commercially-available acrylic resin of this type is Rhoplex WL-91 latex sold by Rohm and Haas Co.

The amount of resin comprising the autodepositing composition can vary over a wide range. For many applications, good results can be achieved utilizing about 25 to about 100 g/l of resin solids in the composition.

Optional ingredients can be added to the composition as desired. For example, it is believed that the present invention will be used most widely with pigmented autodepositing compositions. For this purpose, suitable pigments can be included in the composition, for example, in the form of an aqueous dispersion thereof.

Aqueous dispersions of pigments, like aqueous dispersions of resin solids, include surfactants or dispersing agents for maintaining the particles in dispersed state. In utilizing such dispersions to formulate autodepositing compositions, they should be selected so that the surfactant concentration in the aqueous phase of the composition is below the critical micelle concentration, preferably below the surfactant concentration which corresponds to the inflection point on a graph of surface tension versus the logarithm of surfactant concentration in the composition (see aforementioned U.S. Pat. No. 4,191,676).

Examples of other additives that may be used in the autodepositing composition are those generally known to be used in formulating paint compositions, for example, UV stabilizers, viscosity modifiers, etc.

As mentioned above, the wet strength of coatings formed from compositions for use in the practice of the present invention is such that is rinse resistance is at least about 30 seconds. The wet strength of the coating refers to the cohesive and adhesive properties of the freshly formed coating, that is, the coating in its wet state and prior to the time it dries and coalesces into a continuous film. The test for evaluating the wet strength of the coating in terms of its rinse resistance is as follows. An unpolished cold rolled steel panel (Q-panel) 3"×4" is immersed in the coating composition for 90 seconds. Upon withdrawing the coated panel from the coating composition, it is substantially immediately (within a fraction of a second to a couple of seconds) subjected to a stream of deionized water which runs from a faucet at the rate of 2 L/min and a pressure of 2½ psi under the following conditions. The coated panel is placed under the stream of water at an angle of 45° to the stream of water and at a location such that the place of impingement of the water on the inclined coated panel is six inches from the nozzle of the faucet. The coated panel is held in this position for a measured period of time. The rinse resistance of the coating is measured in terms of the time it takes for the running water to rupture the coating (as viewed by the naked eye) as it impinges thereon. For the purpose of the present invention, the coating composition should be capable of forming a coating which is not ruptured by water impinging thereon in the manner described above for a period of at least about 30 seconds and preferably at least about 60 seconds.

Autodepositing compositions capable of forming coatings having a wet strength whose rinse resistance is about 30 seconds or more are know, but there are autodepositing compositions that are not capable of forming such coatings. Speaking generally, the type of latex used in formulating autodepositing compositions seems to be the influencing factor with regard to the performance of the composition, although there are other factors such as the age of the composition, that is, the extent to which it has been used over a period of time. An autodepositing composition formulated from the preferred vinylidene chloride copolymer latexes described herein generally form coatings whose wet strength is excellent—even to the extent that it is not possible to rupture them under the aforementioned test conditions. If a particular autodepositing composition does not form coatings having the desired wet strength, steps can be taken in accordance with prior art procedures to modify their coating characteristics so that they form the desired type coatings. For example, European Patent No. 186113 discloses that the addition of a surface-active agent, for example, alkylated diphenyloxide disulfonate to an autodepositing composition can effect an increase in the wet strength of freshly formed autodeposited coatings.

A preferred means for implementing the process of the present invention involves placing the small-sized articles in a container having a bottom and side walls which permits the liquid coating composition to flow therethrough into contact with the batch of articles held therein. An open-top, plastic-coated metal wire basket is an example of a suitable container. The container is immersed into the liquid coating composition with a force such that the articles are buoyed upwardly by the liquid composition and separated from contact with each other. The separated articles then fall under gravitational force through the composition. Thus, the entirety of the area to be coated of the article is contacted with the composition as the composition flows around each article. It should be appreciated that the time the articles are pushed upwardly by the liquid composition and the time of their free fall in the composition can be rather short, for example, a few seconds. The free fall of the articles terminates in the bottom of the container which can be withdrawn from the bath of composition after a time sufficient to form the desired amount of coating on the articles. A container of articles, as described above, can be immersed in a bath of coating composition manually or mechanically, for example, by a mechanical arm carried on a conveyor belt of the type that can be used in a continuous coating process.

Another preferred means for implementing the process of the present invention involves dropping the small-sized articles into a bath of the coating composition and permitting them to fall through the liquid composition out of contact with each other for a period of time sufficient to coat the articles to the desired extent. The coated articles are collected in the composition and removed therefrom.

The use of a tumbler having a barrel which is immersed in a bath of the autodepositing composition and which is rotated about its longitudinal axis is another recommended means for practicing the present invention. The barrel of the tumbler can be made effectively of plastic-coated metal wire which permits the autodepositing composition to flow into and fill the barrel. As the barrel is rotated about its axis, the small-sized articles are carried upwardly along the wall of the barrel until they tumble away from the wall, fall downwardly, and move out of contact with other of the articles. This allows the entirety of the surface of the article to be coated. It is recommended that rotation of the barrel be terminated before it is removed from the bath of coating composition. This avoids damaging the wet soft coatings on the articles. After the coatings are coalesced, it is recommended that the coated article be immersed in the composition for coating "contact" areas that were not coated initially. This can be accomplished, for example, by immersing the barrel containing the coated articles into the bath of coating composition and repeating the tumbling operation.

The activity of the autodepositing composition can be an important factor in forming defect-free coatings on small-sized articles which are processed in accordance with the present invention. The term "activity" refers to the rate at which coating is formed on the article by the autodepositing composition. The activity must be such that sufficient coating is deposited on the articles within the time that they are separated from each other in the composition. However, it has been found that autodepositing compositions which are effective in forming defect-free coatings on certain types of articles are not effective in forming such coatings on other types of articles, for example, articles that have threaded parts such as screws bolts, and nuts. After extensive developmental work, it has been determined that threaded articles can be coated effectively in an autodepositing composition that has a reduced activity relative to a composition that is used effectively to coat "plain surface" articles. In this connection, it is noted that U.S. Pat. Nos. 4,178,400; 4,199,624; and 4,242,379 (each assigned to the same assignee as the present invention) disclose that there is a tendency for autodepositing compositions to form defective coatings on metallic surfaces which are highly active, for example, surfaces which have been roughened or "worked" such as by forming, stamping, bending, drawing, shearing, or similar operations. The defects manifest themselves in the form of blisters, craters, pinholes and bridging. The patents disclose further that these types of problems can be avoided by pretreating the surface before it is coated with an acidic aqueous solution (the aforementioned '624 patent) or with an aqueous solution of an acid inhibitor, such as a chromate or dichromate (the aforementioned '379 patent) or by including in the autodepositing composition an acid inhibitor such as a chromate or dichromate (the aforementioned '400 patent).

While any of these methods may be used to passivate or deactivate the highly active sites on the metallic surface, it is preferred, in accordance with the present invention, to adjust the activity of the autodepositing composition by lowering it. This can be done, for example, by reducing the concentration of the activator, or more preferably, by reducing the concentration of the resinous film-forming material. Accordingly, in coating articles having highly active sites, it is recommended that there be used an autodepositing composition having an activity such that it deposits no greater than about 0.3 mil of coating within about 1 second. For this purpose, it is recommended that there be used an autodepositing composition which includes about 10 to about 40 grams/liter of resin solids.

Various steps of the overall coating process can be like those of the prior art, except as noted below. For example, cleaning of the metallic surface prior to coating and any water rinse steps effected subsequently to the cleaning step can be in accordance with the teachings of aforementioned U.S. Pat. No. 4,191,676. Agitating the composition aids in maintaining it uniform and in improving the uniformity of the coatings formed. Other factors held constant, heating of the composition will result in heavier coatings. However, satisfactory results can be obtained operating the coating process at room temperature.

The depth of the liquid coating composition should be sufficient to accommodate the free fall of the articles for the period of time needed to coat the articles to the desired extent. Such depth is dependent on a number of different factors, including, for example, the relative specific gravities of the composition and the metal articles, the viscosity of the composition, and the activity of the composition. The free fall of the separated articles should be at least sufficiently long for the composition to form on the entirety of the surface of the article a coating having a thickness of at least about 0.05 mil. Preferably, the thickness of the coating is about 0.1 to about 1 mil, most preferably about 0.5 mil. For most applications it is believed that the articles will be coated satisfactorily within a time of free fall in the composition of a fraction of a second to about 3 seconds. However, the overall time of immersion of the coated articles in the bath of composition will generally be longer and may range, for example, from about 10 to about 120 seconds.

Once the articles are withdrawn from the coating composition, they can be treated in one of two ways. One way involves rinsing the coated articles after they have been withdrawn from the composition to remove therefrom residuals such as acid and other ingredients that adhere to the coated surface as a result of their being treated with the coating composition. If such residuals are allowed to remain on the coated surface, they may change or adversely affect the quality of the coating. For example, if unreacted coating composition isn't rinsed away, it can form bridges between the coated parts which can cause defects in the coating. Such residuals can be conveniently removed, for example, by rinsing with tap or deionized water. In preferred form, the articles are rinsed under conditions such that they are not in contact with each other.

After the coated articles are rinsed, they should be subjected to conditions which render the coating continuous. A freshly formed coating is typically noncontinuous, highly porous and of low strength relative to the continuous form of the coating. As is known, some resins will coalesce into a continuous film at room temperature; others will not or require too much time to do so. The term "cure" is used herein broadly to mean that the coating is rendered continuous, thereby decreasing its porosity and improving its adherence to the underlying metallic surface. If curing cannot be effected, or takes too long, at room temperature, curing can be accomplished conveniently by the use of heat, for example, baking in an oven or subjecting the coated articles to a steam or hot water cure, for example, as described in U.S. Pat. Nos. 4,562,098 and 4,647,480. Other means can be used to cure the coating, for example, radiation.

If the articles are separated one from the other during the rinsing operation, defect-free coatings can be realized in an application where the coated articles are in contact with each other or out of contact with each other as their coatings are cured. On the other hand, if the articles are not rinsed after they have been withdrawn from the composition and prior to curing, they should be cured under conditions such that the articles are out of contact with each other.

It should be understood that the coated articles can be subjected to other treatments prior to the time the coatings are cured. In this connection, it is noted that it is known to improve various properties of autodeposited coatings by subjecting the wet uncured coatings to treatments such as rinsing, or otherwise contacting the coated articles, with materials such as an alkaline solution (U.S. Pat. No. 4,647,480), a chromium containing solution (U.S. Pat. Nos. 3,795,546; 4,030,945; and 4,637,839), or with a phosphoric acid solution (U.S. Pat. No. 3,647,567).

Although it is believed that the present invention will be used most widely in connection with the formation of autodeposited coatings, it can be used in other applications also, for example, electrocoating and other coating processes involving the use of a reactive type coating composition.

It should be appreciated that many types of small-sized articles can be coated effectively utilizing the techniques described herein. Some examples of such articles include non-threaded fasteners such as spikes, nails, rivets, staples, and masonry anchors; threaded articles such as wood screws, metal screws, bolts, and nuts; and other articles such as turn buckles, and locking washers.

Figure 1B:
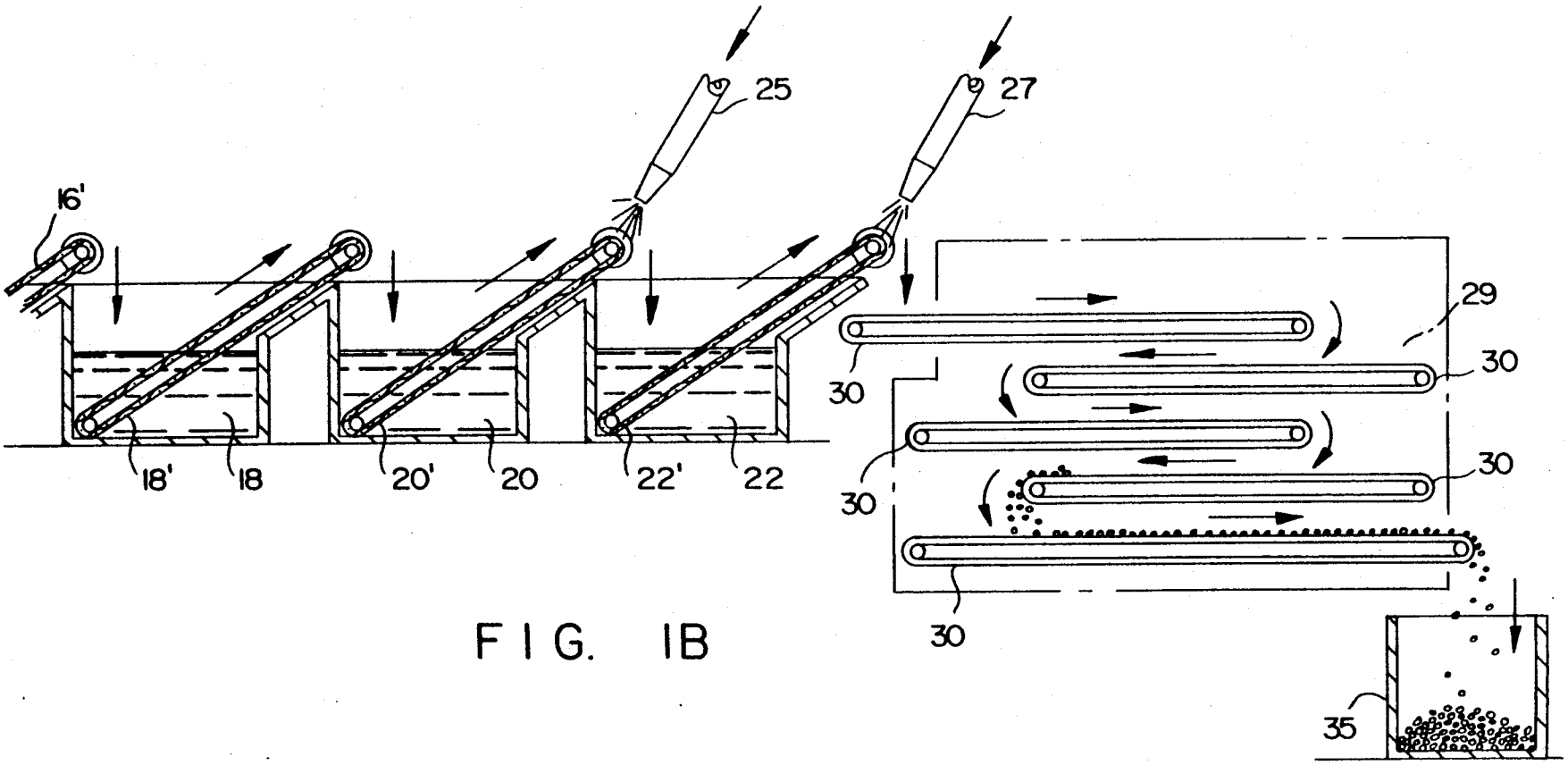

FIGS. 1A and 1B hereof are a schematic representation of an example of a continuous system that can be used in the practice of the present invention to coat a plurality of small metallic articles. These drawings show the use of conveyor lines to carry the articles to and through various treating stages, including cleaning, rinsing, coating, and curing stages. More particularly, a batch of metallic articles (A) is contained in a hopper 2 equipped with a gate 4 through which they fall into a container of cleaning composition 6 and land on a conveyor belt 6' which carries the articles upwardly and out of the composition 6 to the edge of another container of cleaning composition 8 into which they fall onto conveyor belt 8' and are removed as described in connection with the container of cleaning composition 6. The conveyor belts can be made advantageously of a material through which the cleaning composition can flow such as metal screen. The nature on the soil on the articles governs the type of cleaning composition that should be used, such being selected in accordance with knowledge in the art. The same type of cleaning composition can be used in each of the containers, with the cleaning composition of the first container removing most of the soil and the cleaning composition of the second container removing the last of the residual soil. In similar fashion, the articles are carried into and are rinsed in containers 10 and 12 which comprise baths of water which rinse from the articles chemicals from the cleaning composition that may adhere thereto. Conveyor belts 10' and 12' are used to convey the articles out of their respective containers, the articles not being shown in the next several treating stages. In an effort to ensure that the articles are free of residual chemicals or other materials that may affect adversely the application of coatings thereto and that may contaminate the coating composition, they are rinsed in containers 14 and 16 which hold deionized water. Conveyor belts 14' and 16' are associated with their respective containers 14 and 16. After rinsing with deionized water, the articles are dropped into a container of coating composition 18, for example, an autodepositing composition. The articles fall into the coating composition out of contact with each other and are carried therefrom by the conveyor belt 18' to the edge of a container of a water rinse 20 into which they fall out of contact with each other and are carried therefrom by the conveyor belt 20' to the edge of a container of a hot-water rinse 22 into which they fall and in which the coatings are cured partially. Steam is sprayed onto the coated articles by the nozzle 25 as they fall into the container of hot-water rinse 22 and as they are carried therefrom by conveyor belt 22' by the nozzle 27. For certain applications, it may be desirable to increase the humidity surrounding the coated articles for the purpose of inhibiting cracking of the coating (see, for example, U.S. Pat. No. 4,318,944, assigned to the same assignee as the present invention). The coated, rinsed and partially-cured coated articles are then cured fully in the oven 29 as they are carried therethrough by the series of conveyor belts 30. The coated articles exit from the oven 29 as they drop into bin 20 where they are collected.

Figure 2:
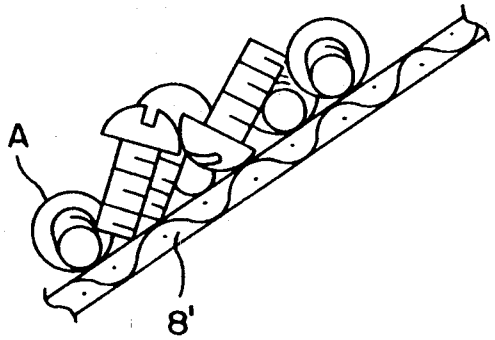
FIG. 2 is an exploded view of a portion of the equipment of FIGS. 1A and 1B illustrating the orientation of small articles as they are transported from one treating stage to the next.

With reference to FIG. 2, there are shown a plurality of bolts as they may be positioned in contact with each other as they are conveyed out of any of the containers described above, including the container of coating composition. It is noted that the conveyor belt 18' associated with the coating composition is advantageously made of a material that will allow the composition to pass therethrough, but on which coating composition will not build up so as to block the openings. A plastic coated screen is an example of such a material.

Examples which follow are illustrative of the practice of the present invention. Comparative examples are set forth also.

EXAMPLES

Example No. 1

The first example is illustrative of the present invention and comprises the use of an autodepositing composition to coat a batch of steel screws contained in a perforated basket. The screws had hexagonal heads, were about ½ to about ¼ inch in length and had a diameter of about 1/16 to about ¼ inch.

The basket consisted of a plastic-coated wire mesh screen and was about 10 cm×10 and 10 cm deep. The basket was filled about three-quarters full with the screws. The screws in the basket were cleaned by immersing in an alkaline cleaning composition and thereafter rinsing with water. The basket of cleaned screws was immersed into a bath of autodepositing composition which was held in a plastic container about 17 cm in diameter and about 60 cm deep. The autodepositing composition was that of the type which is the subject of European Patent No. 186,113 and comprised the following.

| Ingredients | Amounts, g/l |
|---|---|
| acrylic resin latex, 41.5% solids (Rhoplex WL-91) | 92.8 |
| aqueous solution of alkylated diphenyl oxide disulfonate, 45% solids (Dowfax 2A1) | 0.1 |
| 2,2,4-trimethylpentanediol-1,3,-monoisobutyrate (Texanol) | 6.9 |
| ferric fluoride | 1.5 |
| hydrofluoric acid | 1.2 |
| carbon black pigment dispersion (47.3% solids) | 2.6 |
| water to make 1 liter | |

The basket of screws was immersed into the coating composition with a force and speed such that the screws were initially uplifted and separated from each other by a combination of the buoyancy of the liquid and the initial resistance of the liquid being displaced as the screws were immersed. Upon termination of the immersing motion, the initial resistance of the composition disappeared, and the screws, being more dense than the liquid, fell by gravitational force and were collected at the bottom of the basket, which meanwhile had settled to the bottom of the bath. The basket was then withdrawn. The basket of screws was in the composition for about 90 seconds. The free fall of the screws in the composition was about 0.1 second.

After the basket of screws was withdrawn from the bath, the screws were rinsed by immersing the basket in a container of water for about 30 seconds. Thereafter, the coatings on the screws were coalesced by baking in an electric oven at 160 degrees C. for 20 minutes.

Examination of the coated screws showed that each was coated uniformly with autodeposited coating. No bare spots were evident and the coatings were free of defects. The procedure described for this example was repeated for different types, shapes, and configurations of articles. The results obtained were consistently good.

The next three examples are comparative and are illustrative of coating processes which result in the formation of defective coatings.

Example C-1

The autodepositing composition used in this example was as follows.

| Ingredients | Amounts, g/l |
|---|---|
| internally stabilized vinylidene chloride copolymer resin latex, 54% solids (Saran SL 143) | 92.6 |
| ferric fluoride | 3 |
| hydrofluoric acid | 2.5 |
| carbon black pigment dispersion (47.3% solids) | 4 |
| water to make 1 liter | |

The above composition was used to coat a jumbled assortment of nails weighing about 540 g. The nails were contained in a basket 9.5 cm×9.5 cm×10 cm deep which was filled to a height of about 5 cm with the nails.

The nails were subjected to the following treating steps:

(A) cleaned with an aqueous cleaning solution containing sodium phosphate and sodium hydroxide and prepared from 30 g/l of a cleaning agent sold under the trademark RIDOLINE 1727 (Amchem Products, Inc.) by immersing the nails in the solution at a temperature of 71° C. for about 5 minutes;
(B) rinsed by immersing in tap water for 60 seconds;
(C) rinsed by immersing in deionized water for 10 seconds;
(D) coated by immersing in the aforementioned autodepositing composition for 60 seconds;
(E) rinsed by immersing in tap water for 60 seconds;
(F) rinsed by immersing in deionized water for 10 seconds; and
(G) baked for 30 minutes in an electric oven having a temperature of 100° C.

The step of immersing the batch of nails into the bath of autodepositing composition was carried out in a manner such that the basket of nails was placed in the composition rather gently, that is, with a force insufficient to have the buoyant effect of the liquid to uplift and separate the nails.

The baked nails were dumped from the basket onto a paper towel. They were dry and their coatings were fused. Although the nails appeared to be coated completely, close examination showed that almost everyone of the nails had small bare (uncoated) spots - apparently at the points of contact with other nails. The presence of such spots renders the articles unsuitable for effective use.

The next comparative example shows the use of a coating process involving tumbling and the unsatisfactory results that were obtained. The tumbling did not involve immersing the tumbler in a bath of coating composition.

Example C-2

The steps of Example C-1 were duplicated, except as follows. A 3.7 liter polyethylene jug with its top cut off was filled with 1.5 liter of autodepositing composition like that of Example C-1. In the coating step of (D) of Example C-1, the nails in the basket were first moved up and down in the composition in the jug for 10 seconds and in a manner such that the nails were not separated from contact with each other. The basket was then rested on the bottom of the jug and the jug was tilted at about a 45° angle and rotated for 5 seconds. This procedure was repeated for 60 seconds.

Upon completion of the overall process, the baked nails were examined and found to be virtually identical in appearance to those of Example C-1, that is, the coated nails had bare spots and were considered to be unsuitable for effective use.

The next comparative example illustrates the use of a coating process of the type described in Example C-1 above to coat objects of a more complex shape than that of nails.

Example C-3

To investigate whether the shape of the objects being coated is a factor in the quality of the coating that is obtained, small nuts and bolts were coated instead of nails. A random assortment of nuts and bolts was placed in a basket measuring 5.1 cm×7.6 cm and 2.5 cm deep. The treating procedure was similar to that used in Example C-1. The articles were cleaned with a cleaning solution containing aforementioned Ridoline 1727, rinsed in water, and then the basket was immersed for 90 seconds in a bath of autodeposition composition like that of Example C-1. The basket was removed from the bath, and one minute later, the articles in the basket were rinsed with tap water and thereafter with deionized water. The articles in the basket were then baked at 100° C. for 30 min. Examination of the baked nuts and bolts revealed that they had a generally good appearance, but that small holes were evident on several of the nuts and bolts. They were considered unsatisfactory for effective use.

During the development of the present invention, it was observed that coated nails were very difficult to remove from the wood into which they had been hammered, as compared to uncoated nails. In some cases, when a coated nail according to this invention was driven into wood and removed, small particles of wood were observed clinging to the nail.

Upon further investigation, it was observed that when a nut screwed onto its complementary bolt, both pieces being coated in accordance with this invention, the nut was extremely hard to remove by unscrewing. In one case, an uncoated nut that was easily screwed onto and off its complementary uncoated bolt by hand, could not be removed without the assistance of hand tools when in its coated form it was screwed onto a coated bolt. This behavior was not observed in otherwise identical, but uncoated, nuts and bolts.

The foregoing phenomenon has been observed in connection with fasteners coated with autodeposited internally stabilized vinylidene chloride copolymers. In further testing in an attempt to characterize the phenomenon, it was discovered that it was exhibited to a lesser degree when the coating was "overbaked", that is, cured for a longer than average time. (The amount of curing may be defined as minimally the level at which the resin coating is adhered to the dry metal surface and is not readily rubbed off and maximally the level at which the resin coating forms a hard adhering coating which is not degraded by the manner of curing. The "normal" or "average" level of curing, as used herein, refers to the level between minimum and maximum at which the resin coating is sufficiently integral for most subsequent uses of the treated object.) The phenomenon was exhibited optimally when the coating was cured for a less than average time up to an average time. From this, it was extrapolated that the phenomenon was exhibited only when the coating was cured in a range from the minimal acceptable level to normal (i.e., "average") and disappeared or was lessened when the coating was cured from slightly above the normal level up to the maximum acceptable level.

As a theoretical explanation, which is not intended to be limiting, it is believed that a lesser-cured up to normally-cured coating exhibits a thermoplastic quality which is diminished with an increased degree of cure. The heat of friction generated by driving a nail or screwing a nut onto a bolt causes a thermoplastic flow which, upon hardening, helps hold the fastener in place. The small pieces of wood observed clinging to the coating of a nail removed from the wood into which it was driven, appear to confirm this. It might also be speculated that the heat of friction also acts to further cure the coating, so that it becomes less thermoplastic after the fastener is used.

The industrial applications of this observed property are very interesting. Driven, non-threaded fasteners such as spikes, nails, rivets, staples, masonry anchors, etc. and driven threaded fasteners such as wood screws, metal screws, etc., can be rendered far more secure by first coating them with an autodeposited coating according to this invention, which has been cured within the range of minimally acceptable to normal or average. Threaded two or more part fasteners such as machine screws and nuts, bolts and nuts, expansion bolts, turnbuckles, etc., can be rendered self-locking, eliminating the need for locking nuts, locking washers, clinch nuts, etc. by coating all biasing surfaces with an autodeposited coating according to this invention, which has been cured within the range of minimally acceptable to normal or average.

In addition to the increased fastening characteristics, the coated fasteners according to this invention exhibit also excellent resistance to corrosion. Where increased adherence of the fastener parts is not desired, such as where nuts and bolts are to be easily removable, this can be achieved by curing the coating according to this invention longer than normal or average, up to the maximum acceptable level.

We claim:

1. A process for forming an organic coating on a plurality of small metallic articles by contacting the articles with a liquid coating composition containing an organic film forming material, said process comprising:
   (A) providing a plurality of said articles, with at least some of the articles being in contact with at least one other of said articles;
   (B) immersing the plurality of articles into a bath of said composition under conditions such that the articles are not in contact with another article in said composition;
   (C) maintaining the articles in separated form and in free fall under gravitational force in said composition for a period of time sufficiently long for the entirety of the surfaces of the articles to be coated with said composition, thereby forming on the articles an organic coating which is capable of coalescing into a continuous film;
   (D) collecting the coated articles in the bath in a form in which at least some of the coated articles are in contact with another of said coated articles;
   (E) withdrawing from said composition said coated articles, including those in contact with other of said articles; and thereafter
   (F-1) rinsing said coated articles with water and forming said continuous film from said coating; or
   (F-2) forming said continuous film on said coated articles under conditions such that the coated articles are not in contact with another article;

wherein the coating composition is capable of forming on a steel panel immersed therein a coating having a wet strength such that its rinse resistance is at least about 30 seconds.

2. A process according to claim 1 wherein said composition is an autodepositing composition and forming on said articles an autodeposited resinous coating.

3. A process according to claim 2 wherein said articles are maintained in separated form for a period of time sufficiently long to form at least about 0.05 mil of autodeposited coating on the entirety of the surfaces of of said articles.

4. A process according to claim 3 wherein said articles are maintained in separated form for a period of time ranging from a fraction of a second to about 3 seconds and forming on said articles coatings having a thickness of about 0.1 to about 1 mil.

5. A process according to claim 4 wherein the thickness of said coating is about 0.5 mil.

6. A process according to claim 2 including coating articles with a composition having an activity such that it is capable of forming an amount of coating on said articles of no greater than about 0.3 mil within about one second.

7. A process according to claim 2 including immersing into said composition a batch of said articles in a container having bottom and side walls which permit the composition to flow therethrough into contact with the batch of articles and immersing said container into said composition with a force sufficient to cause the articles to move upwardly and separate from each other.

8. A process according to claim 2 including dropping said articles into said composition, collecting the articles on a conveyor belt and withdrawing the coated articles from said bath on said conveyor belt.

9. A process according to claim 2 including coating said articles by tumbling them in a tumbler which is immersed in a bath of said composition.

10. A process according to claim 2, wherein the coating formed by the end of step (E) has a rinse resistance of at least 30 seconds.

11. A process according to claim 10, wherein the autodeposition composition consists essentially of ferric fluoride, hydrofluoric acid, and dispersed resin solids.

12. A process according to claim 3, wherein the coating formed by the end of step (E) has a rinse resistance of at least 30 seconds.

13. A process according to claim 12, wherein the autodepositing composition consists essentially of ferric fluoride, hydrofluoric acid, and dispersed resin solids.

14. A process according to claim 4, wherein the coating formed by the end of step (E) has a rinse resistance of at least 30 seconds.

15. A process according to claim 14, wherein the autodepositing composition consists essentially of ferric fluoride, hydrofluoric acid, and dispersed resin solids.

16. A process according to claim 5, wherein the coating formed by the end of step (E) has a rinse resistance of at least 30 seconds.

17. A process according to claim 16, wherein the autodepositing composition consists essentially of ferric fluoride, hydrofluoric acid, and dispersed resin solids.

18. A process according to claim 6, wherein the coating formed by the end of step (E) has a rinse resistance of at least 30 seconds.

19. A process according to claim 18, wherein the autodepositing composition consists essentially of ferric fluoride, hydrofluoric acid, and dispersed resin solids.

20. A process according to claim 8, wherein the coating formed by the end of step (E) has a rinse resistance of at least 30 seconds.

* * * * *